US009131766B2

(12) United States Patent
Jimenez et al.

(10) Patent No.: US 9,131,766 B2
(45) Date of Patent: Sep. 15, 2015

(54) ORAL CARE IMPLEMENT

(71) Applicant: COLGATE-PALMOLIVE COMPANY, New York, NY (US)

(72) Inventors: Eduardo Jimenez, Manalapan, NJ (US); Robert Moskovich, East Brunswick, NJ (US); Sharon Kennedy, Randallstown, MD (US); John Gatzemeyer, Hillsborough, NJ (US); Michael Rooney, Millburn, NJ (US); Joachim Storz, Zell am See (AT); Raimund Klausegger, Vienna (AT)

(73) Assignee: COLGATE-PALMOLIVE COMPANY, New York, NY (US)

( * ) Notice: Subject to any disclaimer, the term of this patent is extended or adjusted under 35 U.S.C. 154(b) by 0 days.

(21) Appl. No.: 14/288,357

(22) Filed: May 27, 2014

(65) Prior Publication Data

US 2014/0259485 A1 Sep. 18, 2014

Related U.S. Application Data

(63) Continuation of application No. 13/130,191, filed as application No. PCT/US2010/022557 on Jan. 29, 2010, now Pat. No. 8,732,889.

(51) Int. Cl.

| | |
|---|---|
| ***A46B 9/04*** | (2006.01) |
| ***A46B 9/06*** | (2006.01) |
| ***A46B 15/00*** | (2006.01) |

(52) U.S. Cl.

CPC ... *A46B 9/04* (2013.01); *A46B 9/06* (2013.01); *A46B 15/0002* (2013.01); *A46B 15/0032* (2013.01); *A46B 15/0055* (2013.01); *A46B 2200/1066* (2013.01)

(58) Field of Classification Search

CPC ..... A46B 9/04; A46B 9/06; A46B 15/0002; A46B 15/0032; A46B 15/0055; A46B 2200/1066

USPC ..... 15/167.1, 22.1, 110, 22.2, 106

See application file for complete search history.

(56) References Cited

U.S. PATENT DOCUMENTS

| | | | | |
|---|---|---|---|---|
| 1,268,544 | A | 6/1918 | Lorwin | |
| 2003/0159224 | A1 | 8/2003 | Fischer et al. | |
| 2004/0200016 | A1 * | 10/2004 | Chan et al. | 15/22.1 |
| 2005/0166342 | A1 | 8/2005 | Hohlbein | |
| 2006/0080799 | A1 | 4/2006 | Lucente | |
| 2006/0236478 | A1 * | 10/2006 | Hohlbein et al. | 15/110 |
| 2007/0056128 | A1 | 3/2007 | Hohlbein | |
| 2008/0178401 | A1 | 7/2008 | Claire-Zimmet et al. | |

FOREIGN PATENT DOCUMENTS

| | | |
|---|---|---|
| DE | 10 2006 016939 | 5/2007 |
| WO | WO 2004028293 A1 * | 4/2004 |

OTHER PUBLICATIONS

International Search Report issued in International Application PCT/US2010/022557 mailed Oct. 5, 2010.

* cited by examiner

*Primary Examiner* — Shay Karls

(57) ABSTRACT

An oral care implement such as a toothbrush includes a head defining a longitudinal axis and a plurality of tooth cleaning elements supported by the toothbrush head. The tooth cleaning elements preferably include at least one tooth polishing unit having a polishing element including a supporting base and a flexible tooth polishing head extending angularly from the base and defining a polishing surface. In a preferred embodiment, the polishing element is made of an elastomeric material. In some embodiments, the polishing element may be comprised of a plurality of individual polishing members.

14 Claims, 8 Drawing Sheets

ORAL CARE IMPLEMENT

CROSS REFERENCE TO RELATED APPLICATIONS

This application is a continuation of U.S. application Ser. No. 13/130,191, now U.S. Pat. No. 8,732,889, issued May 27, 2014, which is a U.S. National Stage Application under 35 U.S.C. §371 of International PCT Application No. PCT/US2010/022557, filed Jan. 29, 2010. The entirety of each of the foregoing applications is incorporated by reference herein.

FIELD OF INVENTION

The present invention relates to oral care implements, and more particularly to a toothbrush with tooth cleaning elements.

BACKGROUND

Oral care implements such as toothbrushes are typically used in conjunction with a dentifrice for cleansing the teeth and/or soft tissue in the oral cavity. The dentifrice or similar oral care product may contain one or more ingredients which, when administered with a toothbrush generally via a brushing action, provide an oral health benefit to the user such as removing plaque and debris from the surface of the teeth and/or gums, polishing and whitening the teeth, protecting from sensitivity, reducing oral surface bacteria populations, and others.

Conventional toothbrush heads generally contain a plurality of tooth cleaning elements such as bristles which temporarily support the dentifrice during its application to the teeth and/or gums. By design, such bristles usually are formed into tufts containing numerous individual bristle strands (typically made of nylon or another polymer) and are primarily adapted for removing debris. These general purpose bristles are not optimized for polishing and removing stains from tooth surfaces or applying an oral care material to decrease sensitivity, particularly when used with a dentifrice containing, anti-sensitivity, whitening and polishing agents. The tips of the individual bristle strands make less than ideal surface area contact with tooth surfaces to achieve the optimum type of polishing and or filling action desired to effectively reduce sensitivity, remove stains, and polish and whiten the teeth.

An improved toothbrush head with elements for filling, polishing and whitening the teeth is therefore desired.

SUMMARY

An oral care implement such as a toothbrush according to one embodiment of the present invention includes a plurality of tooth cleaning elements including one or more polishing units configured and adapted to provide enhanced cleaning, filling, polishing, and whitening of the teeth. In preferred embodiments, the polishing units include elastomeric polishing elements having a polishing head and preferably a bristle element disposed at least partially inside the polishing element. At least one, but preferably at least two polishing units are disposed among a field of bristle elements formed of one or more bristle tufts of various configuration as described herein that are disposed on the head of the toothbrush.

According to one embodiment, a toothbrush for enhanced cleaning, filling, polishing and whitening of the teeth includes a toothbrush head defining a longitudinal axis and a plurality of tooth cleaning elements supported by the toothbrush head.

The tooth cleaning elements include at least one tooth polishing unit having a polishing element including a supporting base and a broadened flexible tooth polishing head extending angularly outwards from the base and defining a polishing surface. In some embodiments, the polishing unit is comprised of a plurality of individual inverted L-shaped polishing members each collectively defining part of the supporting base and the polishing head of the polishing unit. A bristle element may be disposed at least partially inside the polishing unit and preferably between at least two of the individual polishing members. In one exemplary embodiment, the bristle element may have a Y-shape as further described herein.

According to another embodiment, a toothbrush includes a toothbrush head defining a longitudinal axis and a plurality of tooth cleaning elements supported by the head. The tooth cleaning elements may include at least one tooth polishing unit including an elastomeric element and a bristle element disposed at least partially inside the elastomeric element. The elastomeric element preferably has a broadened or flattened/planar flexible tooth polishing head disposed angularly to the bristle element. The polishing head may be supported by and adjoined to a vertical supporting base attached to the toothbrush head. In preferred embodiments, the polishing head is angularly disposed with respect to the supporting base. The elastomeric element in exemplary embodiments has a generally mushroom or umbrella shape with the supporting base being narrower in width than the polishing head.

According to another embodiment, a toothbrush includes a head defining a longitudinal axis and a front brushing side, and a plurality of bristle elements attached to the front brushing side of the head. The toothbrush further includes a polishing unit attached to the front brushing side of the head that may be comprised of a plurality of individual elastomeric polishing members. Each polishing member preferably has a supporting shaft attached to the front brushing side of the toothbrush head and an adjoining flattened polishing head extending angularly from the supporting shaft. In some embodiments, the polishing heads are wedge-shaped when viewed in a horizontal plane. The wedge-shaped polishing heads each define a sector of a circle in an exemplary embodiment and are arranged to collectively form a circular polishing surface. In one embodiment, at least one bristle element is disposed between at least one pair of polishing members. In another embodiment, a Y-shaped bristle element may be interspersed between the polishing members.

BRIEF DESCRIPTION OF THE DRAWINGS

The features of the preferred embodiments will be described with reference to the following drawings where like elements are labeled similarly, and in which.

Figure 1:
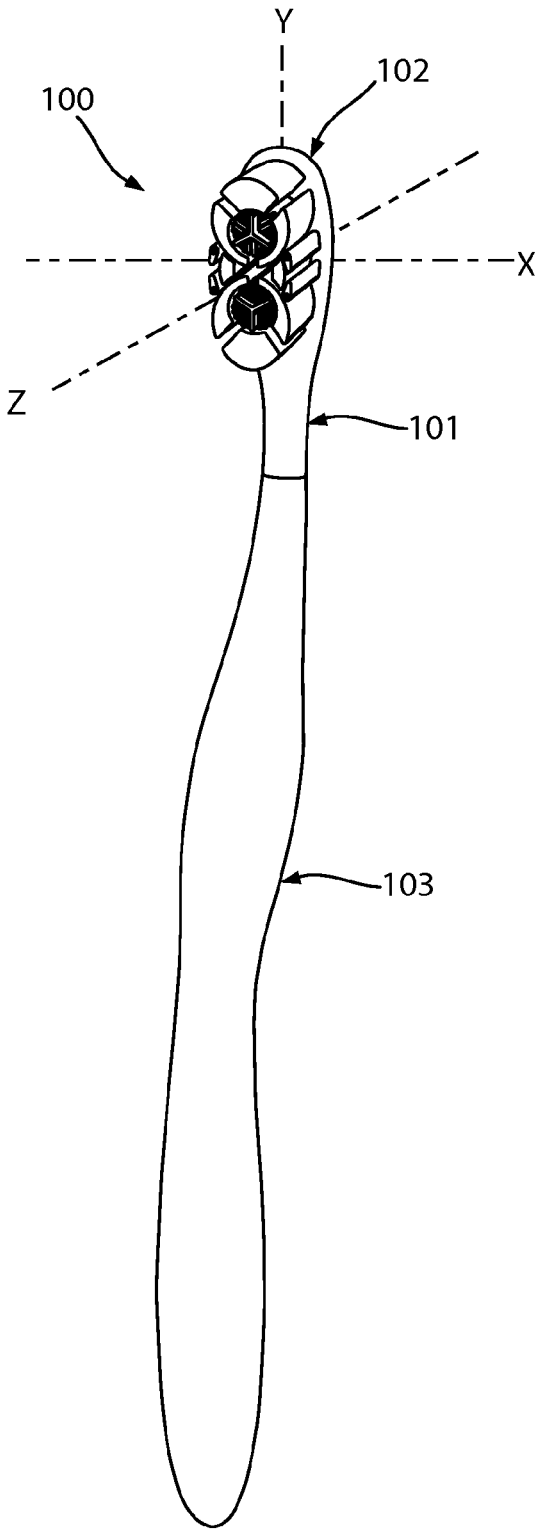
FIG. 1 is a perspective view of a toothbrush according to one exemplary embodiment of the invention.

All drawings are schematic and not actual physical representations of the articles, components or systems described herein, and are further not drawn to scale. The drawings should be interpreted accordingly.

DETAILED DESCRIPTION

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features; the scope of the invention being defined by the claims appended hereto.

FIG. 1 depicts one exemplary embodiment of an oral care implement in the form of a toothbrush 100 including a head 102 having a neck portion 101 and a handle 103 for grasping by a user. The handle 103 may be permanently or detachably coupled to the neck portion 101; the latter detachable handle example being suitable for a toothbrush having user-replaceable heads. The handle 103 is generally elongated in shape and may have any suitable ergonomic and aesthetically pleasing configuration dimensioned to gripped by a user. The handle 103 may be formed of one or more suitable materials conventionally used in the art for toothbrush handles including without limitation polymers, rubber, thermoplastic elastomers (TPE), and combinations thereof. Accordingly, the handle 103 may be formed with many different shapes, lengths, and varieties of constructions.

In some embodiments, the handle 103 may form part of a battery-operated toothbrush and include a power source and electric/electronic components. In other embodiments, the handle 103 may have a reservoir containing an oral care material for dispensing into the oral cavity of a user. Accordingly, the toothbrush head 102 is not limited in its application to either manual or battery-operated toothbrushes alone.

Referring to FIGS. 1-5, the toothbrush head 102 includes a front brushing side 104, an opposing rear side 105, two opposing lateral sides 106, 107, a distal end 108, and a proximal end 109 closest to the handle 103. A primary oral care region 110 is defined on the front brushing side 104 between the lateral sides 106 and 107, the distal end 108, and the proximal end 109. In some embodiments, the rear side 105 may define a secondary oral care region 111 supporting a soft tissue cleaner and/or other ancillary tooth or soft tissue cleaning elements (not shown). The toothbrush head 102 may have an elongated elliptical or oval shape in one possible embodiment. The neck portion 101 may be tapered and narrower in width than the head 102 to smoothly transition into the handle 103.

Figure 3:
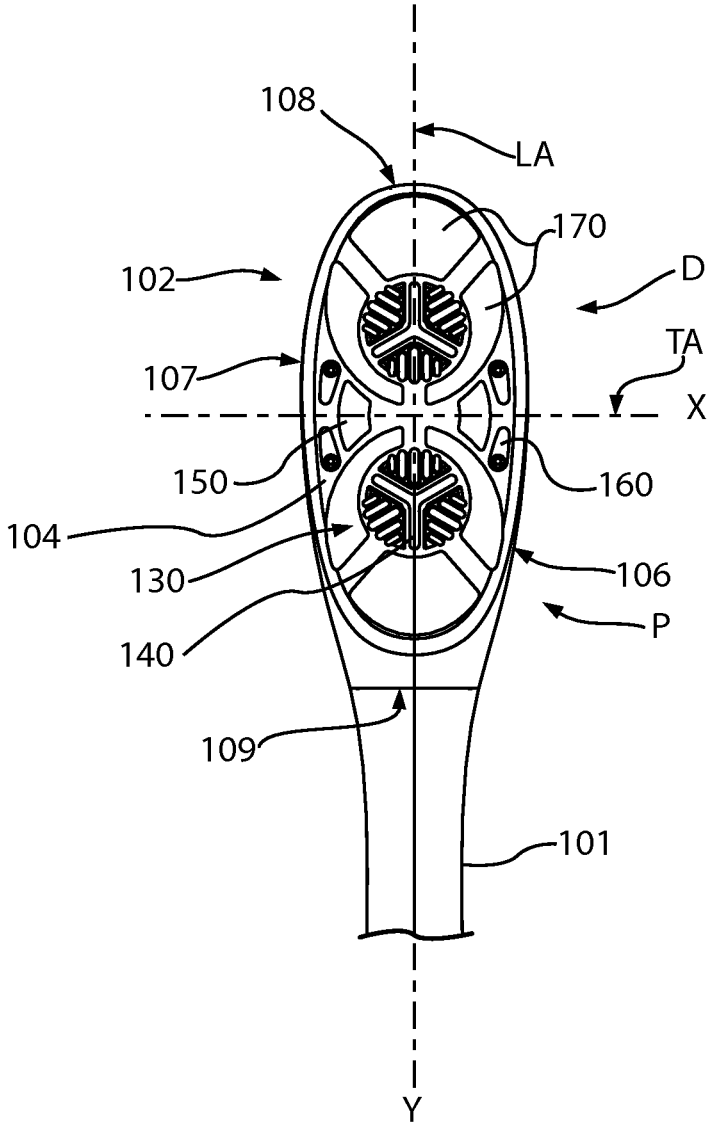
FIG. 3 is a top view of the toothbrush head of FIG. 2.

Referring to FIGS. 1 and 3, an imaginary X-Y-Z coordinate system is identified with respect to the toothbrush head 102 for ease of reference in describing the tooth cleaning elements 120. A horizontal plane and direction is defined by the X-Y axes (generally parallel to front brushing side 104 of toothbrush head 102) and vertical planes and directions are defined by the X-Z and Y-Z axes (generally perpendicular to the front brushing side 104 of the toothbrush head 102). The toothbrush head 102 has a longitudinal axis LA generally coinciding with the X axis and a transverse axis TA perpendicular thereto coinciding with the Y axis and positioned midway between the distal end 108 and the proximal end 109. This divides the oral care region 110 into a proximal treatment half P and distal treatment half D (shown in FIG. 3).

Figure 4:
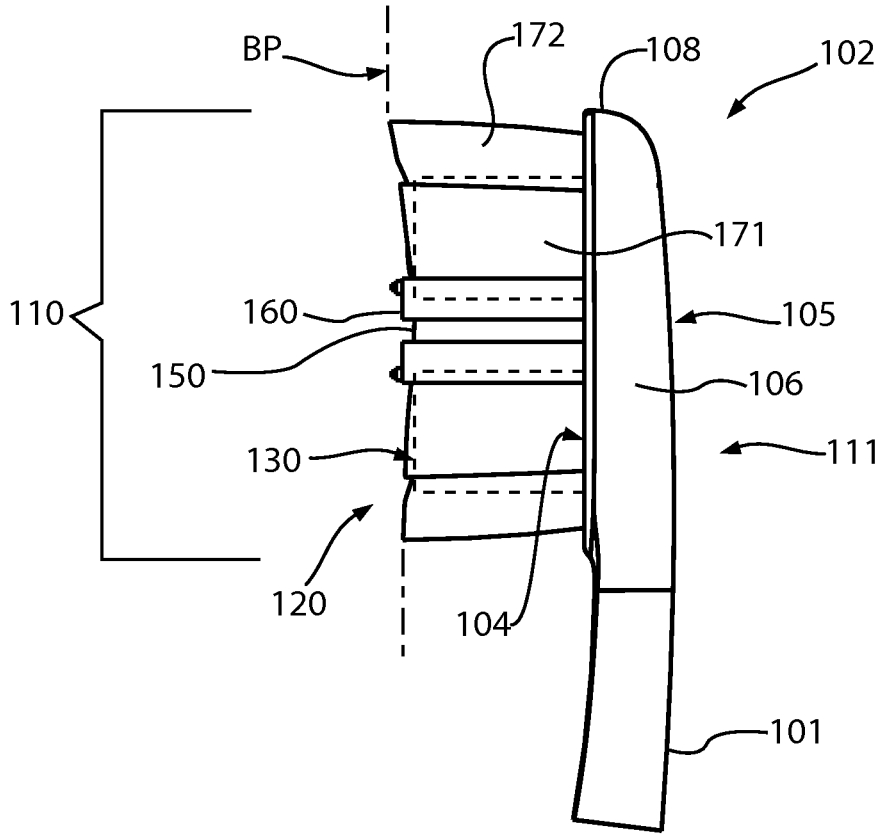
FIG. 4 is a side view of the toothbrush head of FIG. 2.
Figure 5:
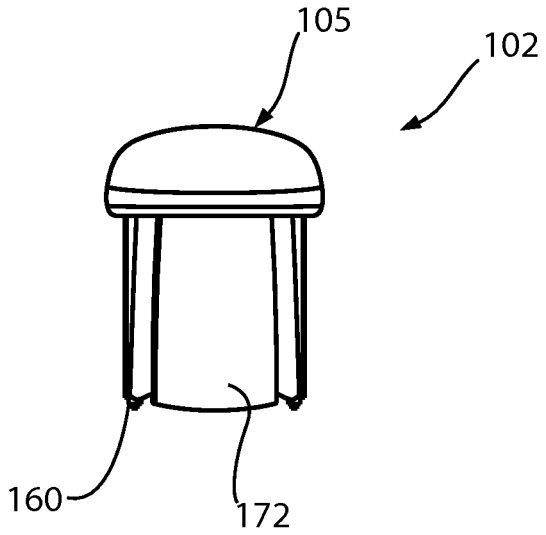
FIG. 5 is a distal end view of the toothbrush head of FIG. 2 (looking towards a handle of the toothbrush)

With continuing reference to FIGS. 1-5, the front side 104 of the oral care region 110 supports a plurality and variety of tooth cleaning elements 120 which extend from the toothbrush head 102. The tooth cleaning elements 120 may include a variety of bristle and elastomeric elements. It should be noted that the bristle tufts or elements in the drawings are illustrated in block form without the individual bristle strands being detailed for convenience and clarity so as to not obscure the structure of the bristle elements described herein. As shown in FIG. 4, an imaginary nominal reference brushing plane BP is roughly defined by the tops/free ends of the tooth cleaning elements 120 which is offset from and approximately parallel to the longitudinal axis LA and the front brushing side 104 of the toothbrush head 102 (with variation allowing for varying heights of the cleaning elements 120). The tooth cleaning elements 120 will now each be described in greater detail.

With continuing reference to FIGS. 1-5, the tooth cleaning elements 120 include at least one tooth polishing unit 130. Preferably, at least two polishing units 130 are provided as shown which may be considered a distal polishing unit and a proximal polishing unit located on either side of the transverse axis TA, as further described herein. The polishing unit 130 is shown schematically in dashed lines in FIG. 3 to show relative position with respect to other tooth cleaning elements to be described herein.

Figure 6:
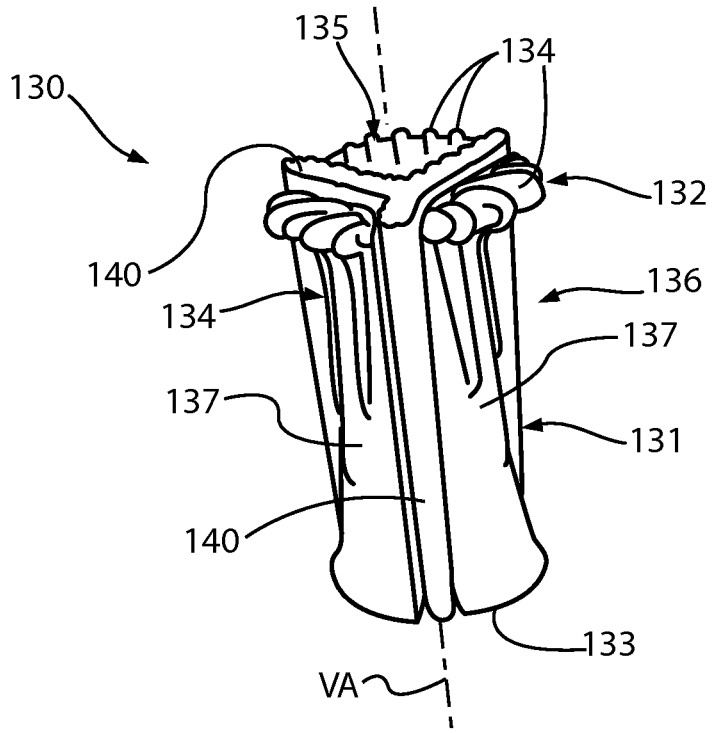
FIG. 6 is a perspective view of a tooth polishing unit of the toothbrush head of FIG. 2.
Figure 7:
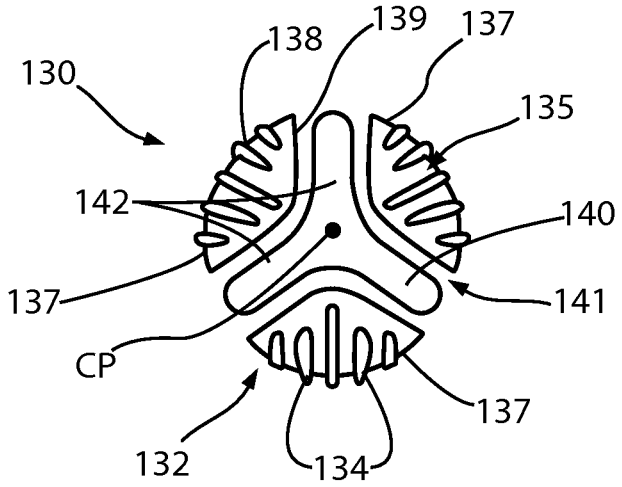
FIG. 7 is a top view of FIG. 6.

FIGS. 6 and 7 show a perspective and top view of the polishing unit 130 disembodied from the toothbrush head 102 for clarity. In one embodiment, the polishing unit 130 includes a resilient/flexible elastomeric tooth polishing element 136 and a bristle element 140 disposed at least partially therein. The polishing element 136 includes an elongated supporting shaft or base 131 and a relatively flattened polishing head 132 disposed on top of the base 131. In a preferred exemplary embodiment, the supporting base has a generally but not necessarily precisely columnar or cylindrical shape in configuration. The polishing head 132 is preferably horizontally broadened in the X-Y plane with respect to the supporting base 131. Accordingly, the polishing head 132 has a larger horizontal width or diameter than the adjoining supporting base 131 as measured in a plane generally parallel to the front side 104 of the toothbrush head 102. The supporting base 131 extends vertically downwards from the polishing head 132 to the toothbrush head 102 and includes a fixed anchoring end 133 which may be attached to front side 104 of toothbrush head 102 by any suitable means conventionally used in the art, including, but not limited to anchor-free tufting (AFT), in mold tufting (IFT), and stapled/anchored.

In exemplary preferred embodiments, the polishing element 136 may have a generally mushroom or umbrella like shape in side view (e.g. T-shaped side cross section) wherein the supporting base 131 is narrower in lateral width than the polishing head 132. Advantageously, this arrangement maximizes the area of polishing surface 135 while providing a flexible attachment to toothbrush head 102 with the narrow supporting base 131.

With primary reference to FIGS. 2, 3, 6, and 7, the polishing head 132 extends horizontally and radially outwards from supporting base 131 and generally perpendicular to a vertical axis VA defined by the supporting base (see FIG. 6). In one exemplary preferred embodiment, the polishing head 132 may form a generally round or circular shape (in top view as best shown in FIGS. 3 and 7) and defines a polishing surface 135 for engaging and cleaning the teeth. However, other shapes are possible. The circular shape of the polishing head 132 and the polishing surface 135 advantageously provides multi-directional cleaning and polishing action on the teeth regardless of which brushing direction the user chooses to employ.

The elastomeric polishing element 136 may be formed of any suitable flexible and resilient material having a shape memory that are conventionally used in the art for making elastomeric toothbrush elements. In some embodiments, without limitation for example, the polishing element 136 may be made of rubber or TPE. In a preferred embodiment, the polishing member 136 including supporting shaft or base 131 and polishing head 132 are formed as integral parts of a unitary elastomeric structure which may be molded such as by injection molding in a single step in a conventional manner. In other embodiments, the polishing head 132 may be molded separately and attached to supporting base 131. Accordingly, the invention is not limited to either construction.

The tooth polishing element 136 may be a single unitary elastomeric structure formed with slits or slots to accommodate a bristle element 140, or in a preferred embodiment may be comprised of two or more separate individual polishing members 137 that may be assembled and arranged in spaced but generally close proximity to collectively form the polishing element 136 and the polishing head 132, as best shown in FIGS. 2, 3, 6, and 7. The polishing members 137 may each be formed of the same exemplary type of materials and constructed in a similar manner to the polishing element 136 described above. Preferably, the polishing members 137 are spaced sufficiently to receive at least a portion of a bristle element such as element 140 described herein which may be interspersed between the polishing members. It will therefore be appreciated that the polishing head 132 need not define a continuous circumferential edge in a preferred embodiment, but instead may be interrupted by gaps or slots in some embodiments when the polishing element 136 is comprised of two or more separate polishing members 137. Preferably, a bristle element is disposed between at least one pair of polishing members 137.

In one preferred embodiment, referring to FIGS. 2, 3, 6, and 7, the tooth polishing element 136 may include three elastomeric tooth polishing members 137 as best shown in FIGS. 6 and 7. The tooth polishing members 137 are arranged proximate to each other and concentrically around a central point CP in spaced relation to each other on the toothbrush head 102 to accommodate bristle elements therebetween as describe above. With additional reference to FIG. 8, the polishing members 137 in one embodiment preferably have an inverted L-shape each with a supporting shaft or base 131 being anchored to toothbrush head 102 via anchoring end 133. The anchoring end 133 may be widened with respect to upper vertical portions of the supporting base 131 near the adjoining polishing head 132 to provide secure yet flexible fixation of the polishing member 137 to the head 102.

Figure 8:
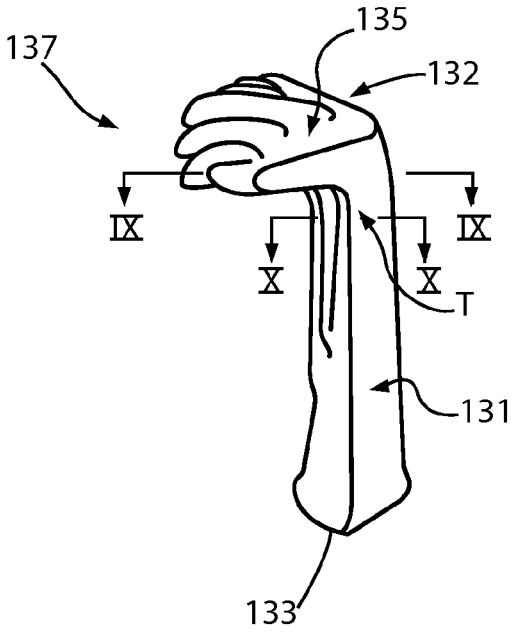
FIG. 8 is a perspective view of an individual polishing member of the tooth polishing unit of FIG. 6.

With continuing reference to FIGS. 6-8, the horizontally extending polishing head 132 (i.e. the shorter horizontal portion of the inverted "L" shape) of each polishing member 137 may have a wedge or fan-like shape in planar extent (i.e. when viewed in a horizontal plane from top). The wedge-shaped polishing heads 132 of each polishing member 137 define circumferentially spaced sectors of a circle in some embodiments with each head having an arcuate outer cleaning edge 138 and two converging lateral or side cleaning edges 139 disposed at an angle to each other which join at common point of origin O positioned circumferentially around and proximate to central point CP (best shown in FIG. 7). In one embodiment exemplary embodiment, therefore, the wedge-shaped polishing heads 132 are preferably arranged to collectively form or approximate a generally circular but circumferentially discontinuous polishing surface 135 providing slots 141 for receiving the bristle element 140.

Preferably, the polishing heads 132 of polishing members 137 have a generally lateral or horizontal orientation (i.e. in the X-Y plane) extending generally parallel to brushing plan BP and front surface 104 of toothbrush head 102 in one embodiment. Accordingly, the polishing head 132 is angularly disposed on each polishing member 137 with respect to the adjoining vertically-oriented supporting base 131. Each polishing head 132 of the polishing members 137 is preferably further oriented to extend radially outwards and away from central point CP with the supporting base 131 of each polishing member being concentrically clustered around central point CP of the polishing unit 130. In some embodiments, each polishing head 132 may be slightly angled upwards in a direction away from point CP in lieu of being parallel to the front surface 104 of the toothbrush head 102 with the arcuate outer cleaning edge 138 being located at a higher elevation than the portion of the polishing head 132 that transitions into the upper transition section T of the supporting base 131 (further described below). When the user applies pressure between the polishing member 137 and teeth during brushing, the resilient elastomeric polishing head 132 will tend to flatten. In that embodiment, therefore, the angle formed between the polishing head 132 and the adjoining supporting base 131 may be greater than 90 degrees. In other possible embodiments, the angle formed between the polishing head 132 and the adjoining supporting base 131 may be approximately 90 degrees or less than 90 degrees.

Figure 9:
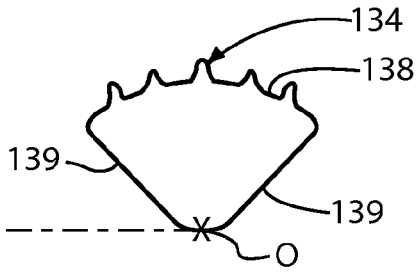
FIG. 9 is a lateral horizontal cross-sectional view of a polishing head of the tooth polishing member of FIG. 8 taken along line 9-9 shown therein.
Figure 10:
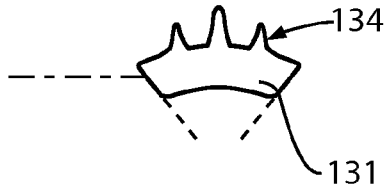
FIG. 10 is a lateral horizontal cross-sectional view of a supporting shaft or base of the tooth polishing member of FIG. 8 taken along line 10-10 shown therein.

FIGS. 9-10 show lateral horizontal cross sections taken from FIG. 8 respectively through the polishing head 132 and a transition section T of the supporting base 131 immediately below the polishing head 132. In one possible embodiment, the transition section T may be shaped as an arcuate segment as shown in FIG. 10. As exemplified by FIGS. 9 and 10, the supporting base 131 preferably has a smaller cross-sectional area than the polishing head 132 to enhance the flexibility of the supporting base and the polishing head 132 while maximizing the available polishing surface area of the polishing surface 135 to provide enhanced polishing and cleaning action.

Referring primarily to FIGS. 7-10, the polishing head 132 may include a plurality of elongated and spaced apart lamellas or ribs 134 to provide enhanced cleaning and polishing action. The ribs 134 are disposed on and extend upwards from the polishing surface 135 and in one exemplary embodiment may be arranged parallel to each other. The ribs 134 may be oriented as best shown in FIG. 7 to extend radially outwards from central point CP. Preferably, the ribs 134 extend from the top polishing surface 135 over and onto the outward facing arcuate outer cleaning edge 138 of the polishing head 132 as best shown in FIGS. 8 and 9.

In one possible embodiment as shown in FIGS. 8 and 9, the supporting base 131 may also include ribs 134 configured and arranged similarly to the ribs 134 on the polishing head 132. The ribs 134 on supporting base 131 preferably are disposed on an outward facing surface of the base and extending in a direction generally away from the central point CP. The ribs 134 on the supporting base 131 need not extend downwards from the polishing head 132 all the way to the anchoring end 133 of the supporting base. Accordingly, the ribs 134 preferably extend at least partially downwards from the polishing head 132 along the height of the supporting base 131 far enough to cover the active cleaning and polishing zone of the polishing member 137 that engages the teeth which will generally be limited to the upper portions of the polishing member.

It will be appreciated that other suitable arrangements of the ribs 134 on the polishing head 132 and the supporting base 131 are possible. Accordingly, the invention is not limited to the number, orientation, or design of the ribs disclosed herein.

Referring now to FIGS. 2-3 and 6-7, the bristle element 140 is preferably disposed at least partially inside the polishing element 136. The bristle element 140 has a generally vertical orientation in an exemplary embodiment extending upwards from the front brushing side 104. The polishing head 132 and the polishing surface 135 defined thereon extend angularly and horizontally outwards from the bristle element 140 as best shown in FIGS. 6 and 7. In one embodiment, the polishing head 132 extends outwards at approximately 90 degrees to the bristle element 140. The polishing unit 130 defines a slot 141 which is configured and adapted to generally conform to the shape of the bristle element 140 received at least partially therein.

Referring to FIGS. 2-3 and 6-7, the bristle element 140 in one exemplary embodiment may be Y-shaped (in lateral horizontal cross section); however, other suitable shapes of the bristle element 140 may be used. For example, in some other embodiments without limitation, the bristle element 140 may have an X shape or five-point star shape and be constructed similarly to the polishing unit 130 already described herein having individual polishing members 137 interspersed between the legs of these shapes to form a generally circular polishing head 132 as described herein. Accordingly, it is well within the ambit of those skilled in the art to create these additional bristle element shapes using the principles and embodiments described herein without undue experimentation or description. In one embodiment, at least a portion of the bristle element 140 crosses through and is located at the central point CP, and more preferably in one embodiment the intersection of all three legs 142 of the Y may coincide with the central point CP (see FIG. 7). In the embodiment shown, all three legs 142 may be of equal length (measured in lateral horizontal cross section) and one of the legs is axially aligned with longitudinal axis LA. In other embodiments, legs 142 need not have the same length. Where the polishing element 136 is comprised of multiple polishing members 137, as described herein, each polishing member is preferably disposed between a pair of legs 142 of the bristle element 140 as shown. In one embodiment, the bristle element 140 extends vertically above the polishing element 136.

It will be appreciated that other embodiments of the polishing unit 130 may have more or less polishing members 137 and other shaped bristle elements 140. Accordingly, the invention is not limited to the exemplary embodiments shown herein.

As best shown in FIG. 3, the polishing unit 130 is preferably centrally positioned in one embodiment between the lateral sides 106, 107 and along the longitudinal axis LA of the toothbrush head 102. In a preferred embodiment, the two axially aligned polishing units 130 may be provided with one unit being disposed between the transverse axis TA and the distal end 108 and another unit being disposed between the transverse axis TA and the proximal end 109. In one exemplary embodiment, at least one of the legs 142 of the bristle element 140 is axially aligned with the longitudinal axis LA of the toothbrush head 102 with the remaining two legs 142 being angled with respect to the axis LA as best shown in FIG. 3. In other embodiments, the legs 142 may have other orientations.

The polishing unit 130 essentially forms a disc-shaped polishing pad for cleaning and polishing the teeth which when accompanied by use of a dentifrice have whitening agents is intended to provide more effective stain removal and whitening action. Advantageously, the generally flattened polishing heads 132 of the polishing members 137 further serve to provide a platform for supporting dentifrice during brushing and reducing migration of dentifrice downwards between the bristles towards the front surface 104 of the toothbrush head 102 for more effective polishing, cleaning, and whitening action.

Referring to FIGS. 1-5, the polishing unit 130 is preferably at least partially surrounded by additional bristle elements that flank the circumferential sides of the polishing unit. In one embodiment, at least two and more preferably three arcuate tooth cleaning bristle elements 170 (in lateral horizontal cross section) are provided each having a concave inner side that faces and partially surrounds polishing unit 130. Each arcuate bristle element 170 is formed of a tuft of bristles made of any suitable bristle material conventionally used in the art. The arcuate bristle elements 170 may include a pair of transversely spaced apart lateral side arcuate elements 171 with one each located adjacent polishing unit 130 near the peripheral edges and the lateral sides 106 and 107 of the toothbrush head 102, and further a third single arcuate axial distal or proximal element 172 positioned along the longitudinal axis LA of the head 102. As best shown in FIG. 3, one axial distal element 172 is preferably located near the distal end 108 of the toothbrush head 102 (forward of the distal tooth polishing unit 130) and another axial proximal element 172 is preferably located near the proximal end 109 of the toothbrush head 102 (rearward of the proximal tooth polishing unit 130 towards the handle 103). In a preferred bristle arrangement, the lateral and axial bristle elements 171, 172 are positioned symmetrically with respect to the longitudinal axis LA as shown in FIG. 3. In other possible arrangements, asymmetrical positioning of the bristle elements 171, 172 may be used.

With continuing reference to FIGS. 1-5, the proximal and/or distal axial bristle elements 172 may be angled or slants such that the height of bristles preferably slopes in a longitudinal upwards direction away from transverse axis TA and towards the distal end 108 and the proximal end 109 of the toothbrush head 102, respectively, as best shown in FIG. 4. The angled arrangement of the axial bristle elements 172 enhances the reach and cleaning of these bristle tufts. The lateral side arcuate elements 171 may also be slanted or angled upwards in a longitudinal direction away from transverse axis TA and the proximal or distal ends 108, 109 of the toothbrush head 102.

Figure 2:
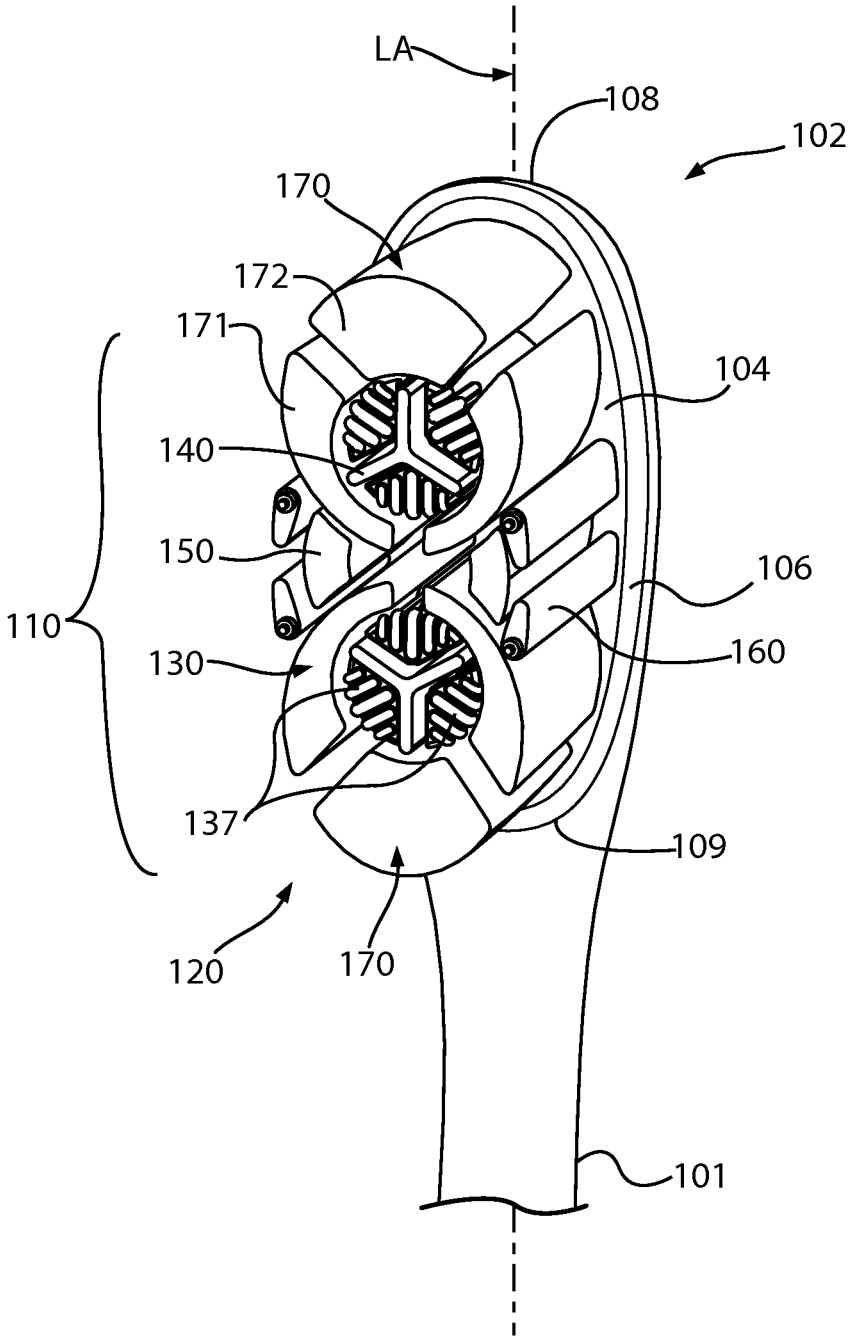
FIG. 2 is a partial perspective view of a toothbrush head thereof.

Referring to FIGS. 2 and 4, in some exemplary embodiments, the polishing units 130 may have a vertical height with respect to the arcuate bristle elements 170 such that that tops of the Y-shaped bristle element 140 is approximately even with the lowest portions of the lateral side arcuate elements 170 and the polishing head 132 of the polishing element 136 is positioned vertically to be slightly below the bristle element 140 and the lowest portions of the lateral side arcuate elements 170. It will be appreciated that other arrangements are possible with respect to the height of the polishing unit 130 and the lateral side arcuate elements 170.

Referring to FIGS. 1-5, the toothbrush head 102 further includes a pair of intermediate tooth cleaning bristle elements 150 which are laterally spaced apart along the transverse axis TA in one preferred embodiment. Each intermediate bristle element is preferably positioned between the longitudinal axis LA and the lateral sides 106 and 107 respectively, and more preferably is positioned between the longitudinal axis LA and the deep cleaning elements 160 as further described herein. In one embodiment, intermediate bristle elements 150 may be located each side of the longitudinal axis LA with one element each being positioned approximately at or near the midpoint between the axis LA and the lateral sides 106 and 107, respectively, as shown. In one exemplary arrangement, the intermediate bristle elements 150 may be formed as arcuately-shaped elements (in lateral horizontal cross section) with a concave portion facing inwards toward the longitudinal axis LA. Preferably, the bristle elements 150 are configured to complement and fit the shape of the gap created between vdeep cleaning bristle elements 160 and the bristle elements 170 as best shown in FIG. 3. These intermediate bristle elements 150 may be comprised of a tuft of bristles formed of any suitable material conventionally used in the art.

Figure 11:
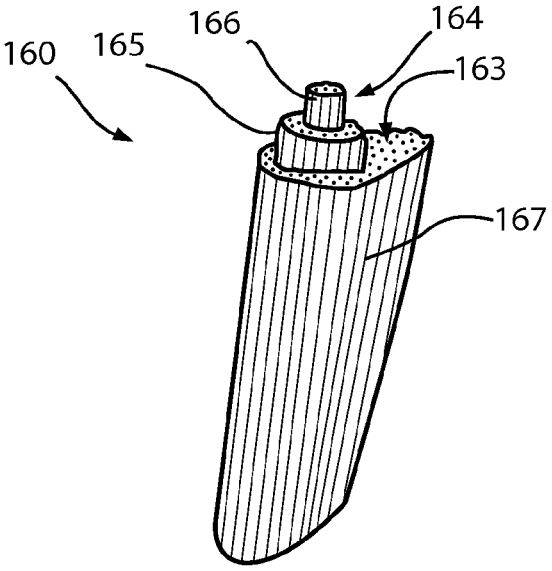
FIG. 11 is a perspective view of a deep cleaning bristle element of the toothbrush head of FIG. 2.
Figure 12:
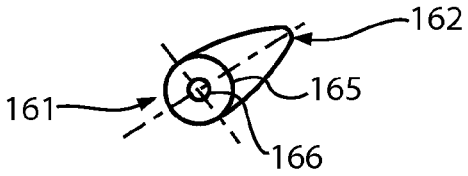
FIG. 12 is a top view of the deep cleaning bristle element of FIG. 11.

Referring to FIGS. 1-5 and 11-12, a plurality of combination side cleaning elements such as deep cleaning bristle elements 160 in one embodiment are provided on toothbrush head 102. The deep cleaning bristle elements 160 efficiently combine vertically higher/taller deep cleaning bristle structures with lower regular height conventional cleaning bristles in a single bristle tuft to conserve the limited space available on front surface 104 of the toothbrush head 102 as further explained. In one exemplary embodiment, the deep cleaning bristle elements 160 may be formed in part by a tuft of conventional cleaning bristles 167 having a tear drop or cam shape (in lateral horizontal cross section) as best shown in FIG. 12, with a relatively stiffer and broad end portion 161 and an opposite narrow more flexible end portion 162. Preferably, the conventional bristles 167 have a relatively uniform vertical height and form a top bristle surface 163 defined by the tips of the bristles.

With continuing reference to FIGS. 1-5 and 11-12, the broad end portion 161 of the deep cleaning bristle elements 160 preferably includes a cylindrically-shaped deep cleaning projection 164 which rises and extends vertically above adjacent portions of top bristle surface 163 formed by the cleaning bristles 167 (best shown in FIG. 11). In one exemplary embodiment, the cleaning projection 164 may be comprised of one or more concentrically aligned cylindrical deep cleaning bristle tufts 165 and 166 as shown which are intended to cleanse the tooth area adjacent the gums and gaps between teeth. The bristle tufts 165 and 166 form a tiered or stepped cleaning structure as best shown in FIG. 11 with the central tuft 166 being vertically higher/taller than the outer bristle tuft 165.

As shown in FIGS. 2 and 3, at least one and preferably two deep cleaning bristle elements 160 are disposed proximate to the lateral sides 106 and 107 of the toothbrush head 102 and the transverse axis TA towards the longitudinal center of the toothbrush head. In a preferred embodiment, a pair of deep cleaning bristle elements 160 are disposed near each lateral side 106, 107 with a deep cleaning bristle element positioned on either side of axis TA and outboard of the intermediate tooth cleaning bristle elements 150. It will be appreciated that additional deep cleaning bristle elements 160 and/or other arrangements are possible.

Figure 13:
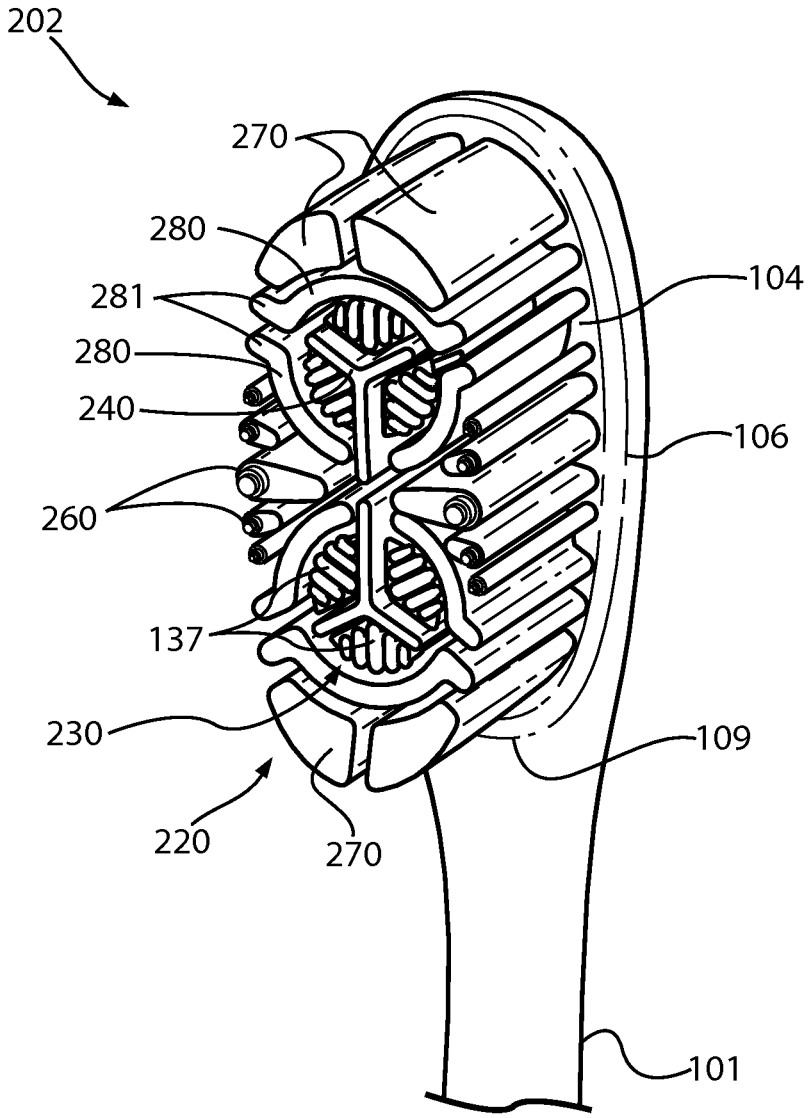
FIG. 13 is a partial perspective view of an alternative toothbrush head of the toothbrush of FIG. 1.
Figure 14:
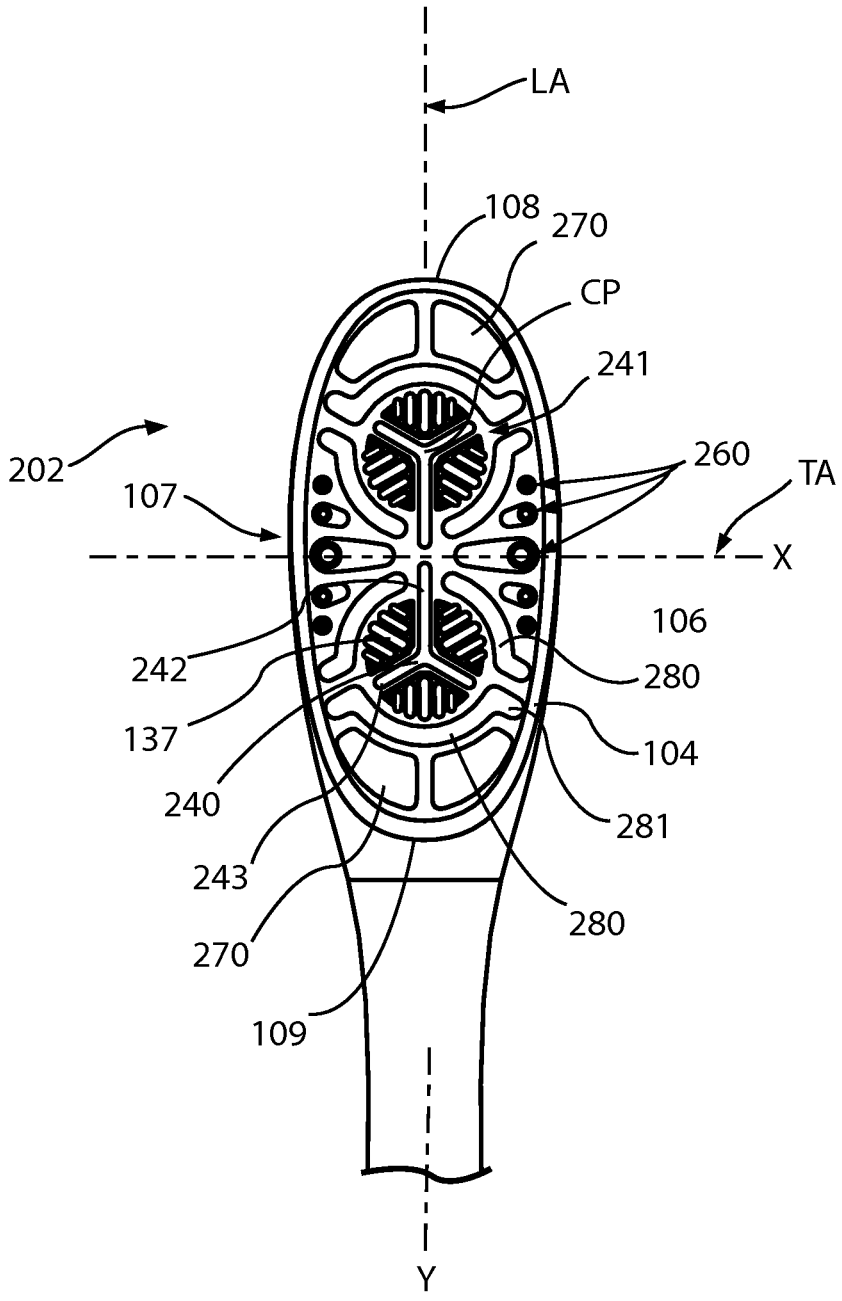
FIG. 14 is a top view of the toothbrush head of FIG. 13.

FIGS. 13 and 14 show an alternative embodiment of a toothbrush head 202 whose structure may be configured similarly to toothbrush head 102 as shown. The toothbrush head 202 incorporates some of the same tooth cleaning elements 120 described herein with a modified arrangement of some of the cleaning elements and adds other new elements. The toothbrush head 202 includes two polishing units 230 comprised of individual polishing members 137 similar to those described herein and a bristle element 240 having a similar, but slightly modified configuration and orientation than bristle element 140. Unlike the bristle element 140 which preferably has three legs 142 of even length in the embodiment shown in FIG. 7 (measured in a horizontal plane parallel to front surface 104 of toothbrush head 102), one leg 242 of the bristle element 240 is longer than the remaining two shorter legs 243. The longer leg 242 is preferably axially aligned with the longitudinal axis LA and extends out of the Y-shaped slot 241 and laterally beyond the polishing members 137 as best shown in FIG. 14. The two shorter legs are disposed at an angle to both the longitudinal axis LA and the transverse axis TA as shown. In a preferred embodiment, the two longer legs 242 of each bristle element 240 are arranged in confronting relationship to each other along the longitudinal axis LA as shown but do not meet or touch leaving a small gap therebetween the ends of the legs. In other possible embodiments (not shown), the longer legs 242 of each bristle element 240 may meet to interconnect both bristle elements 240.

With continuing reference to FIGS. 13 and 14, the toothbrush head 202 further includes two distal arcuate tooth cleaning bristle elements 270 and two proximal arcuate tooth cleaning bristle elements 270 configured and structured similarly to arcuate tooth cleaning bristle elements 170 described herein elsewhere. A plurality of deep cleaning bristle elements 260 similar in configuration and structure to the deep cleaning bristle elements 160 described are also provided on the toothbrush head 202. In one embodiment, a cluster of deep cleaning elements 260 are disposed proximate to lateral sides 106 and 107 of toothbrush head 202 and transverse axis TA towards the center of the toothbrush head. In a preferred embodiment, five deep cleaning bristle elements 260 are disposed near each lateral side 106, 107 with a pair of bristle elements 260 positioned on transverse axis TA (one near each lateral side) and two elements 260 positioned both forward and rearward of axis TA near each lateral side as shown. It will be appreciated that more or less deep cleaning bristle elements 260 and/or other arrangements are possible and may be provided. As shown in FIGS. 13 and 14, the narrow more flexible end portion of each cam-shaped bristle element 260 preferably faces inwards towards longitudinal axis LA whereas in the toothbrush head 102 by comparison the narrow portion is preferably oriented towards transverse axis TA (see, e.g. FIG. 3).

Referring to FIGS. 13 and 14, each polishing unit 230 is at least partially surrounded by three circumferentially-oriented and segmented arcuate tooth cleaning bristle elements 280 (in lateral horizontal cross section). Preferably, the arcuate bristle elements 280 are circumferentially spaced apart as shown and form a ring-shaped bristle element around polishing unit 230. Each bristle element 280 segment may include one or more flanged portions 281 (also formed of bristles preferably) that extend radially and laterally outwards from the polishing units 230. In some embodiments, some or all of the arcuate bristle elements 280 may not be provided with any flanged portions 281 similar to some elements shown. It should be noted that FIGS. 13 and 14 show two exemplary possible flanged portion 281 variations and therefore each bristle element 280 in these two figures may be similar but not necessarily identical in configuration.

The tooth cleaning elements described herein may be attached to the toothbrush head by any suitable conventional method used in the art such as, without limitation for example, anchor free tufting (AFT), in mold tufting, anchor/staple, injection molding, ultrasonic welding, and combinations thereof. In addition, features of the exemplary embodiments described herein may be practiced and incorporated in manual or powered toothbrushes.

The devices and apparatuses described herein utilize conventional, commercially-available components which will be readily known to and obtainable by those skilled in the art. Therefore, it is well within ambit of those skilled in the art to assemble such components to create these devices and to employ the methods described herein for the detection and treatment of oral conditions related to the presence of bacteria or bacterial metabolic products without undue experimentation.

While the foregoing description and drawings represent the preferred embodiments of the present invention, it will be understood that various additions, modifications and substitutions may be made therein without departing from the spirit and scope of the present invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. A toothbrush comprising:

a toothbrush head defining a longitudinal axis;

a plurality of tooth cleaning elements supported by the toothbrush head, the tooth cleaning elements including at least one tooth polishing unit, the tooth polishing unit comprising a polishing element and a bristle element, the polishing element comprising a plurality of tooth polishing members arranged around a central point, each of the tooth polishing members including a base and a tooth polishing head extending angularly from the base and defining a polishing surface that includes a plurality of ribs;

wherein at least a portion of the bristle element intersects the central point; and wherein the tooth polishing members are inverted L-shaped polishing members.

2. The toothbrush of claim 1, wherein the tooth polishing unit is at least partially surrounded by additional bristle elements.

3. The toothbrush of claim 1, wherein each of the tooth polishing members is made of an elastomeric material.

4. The toothbrush of claim 1, wherein each of the tooth polishing heads has a top surface, a length, and a width, the length being greater than the width, and the plurality of ribs protruding from the top surface in a widthwise direction and spaced apart in a lengthwise direction.

5. The toothbrush of claim 1, wherein the at least one tooth polishing unit comprises a first tooth polishing unit and a second tooth polishing unit.

6. The toothbrush of claim 5, wherein the first and second tooth polishing units are axially aligned with the longitudinal axis of the toothbrush head, each of the first and second tooth polishing units being circumferentially surrounded by additional bristle elements.

7. The toothbrush of claim 1, further comprising a plurality of arcuately shaped bristle elements circumferentially surrounding the tooth polishing unit.

8. The toothbrush of claim 1, further comprising at least two deep cleaning bristle elements, each deep cleaning bristle element having a cylindrically shaped vertical projection which extends above adjacent portions of the deep cleaning bristle element for enhanced tooth cleaning.

9. The toothbrush of claim 1, wherein the bristle element extends vertically above the tooth polishing heads of the tooth polishing members.

10. A toothbrush comprising:

a toothbrush head defining a longitudinal axis;

a plurality of tooth cleaning elements supported by the toothbrush head, the tooth cleaning elements including at least one tooth polishing unit, the tooth polishing unit comprising a polishing element and a bristle element, the polishing element comprising a plurality of tooth polishing members arranged around a central point, each of the tooth polishing members including a supporting base and a tooth polishing;

wherein the tooth polishing members are made of a flexible elastomeric material; and wherein for each tooth polishing member the supporting base extends from the tooth polishing head to the toothbrush head and includes an anchoring end attached to a front surface of the toothbrush head, the anchoring end being widened with respect to portions of the supporting base near the tooth polishing head.

11. The toothbrush of claim 10, wherein the tooth polishing members are inverted L-shaped polishing members.

12. The toothbrush of claim 10, wherein the tooth polishing unit is at least partially surrounded by additional bristle elements.

13. The toothbrush of claim 10, wherein each of the tooth polishing heads defines a polishing surface, and wherein at least one of the polishing surfaces includes a plurality of ribs.

14. The toothbrush comprising:

a toothbrush head defining a longitudinal axis;

a plurality of tooth cleaning elements supported by the toothbrush head, the tooth cleaning elements including at least one tooth polishing unit, the tooth polishing unit comprising a polishing element and a bristle element, the polishing element comprising a plurality of tooth polishing members arranged around a central point, each of the tooth polishing members including a supporting base and a tooth polishing head, wherein the supporting base is narrower in width than the tooth polishing head;

wherein the tooth polishing members are made of a flexible elastomeric material; and wherein for each tooth polishing member the supporting base extends from the tooth polishing head to the toothbrush head and includes an anchoring end attached to a front surface of the toothbrush head.

* * * * *